US007448971B1

(12) United States Patent
Smalley

(10) Patent No.: US 7,448,971 B1
(45) Date of Patent: Nov. 11, 2008

(54) REINFORCED WOODEN BASEBALL BAT

(76) Inventor: Leonard Smalley, 35 John Reading Rd., Flemington, NJ (US) 08820

( * ) Notice: Subject to any disclaimer, the term of this patent is extended or adjusted under 35 U.S.C. 154(b) by 0 days.

(21) Appl. No.: 11/888,053

(22) Filed: Jul. 31, 2007

(51) Int. Cl.
*A63B 59/06* (2006.01)

(52) U.S. Cl. ..... 473/564; 473/567

(58) Field of Classification Search ..... 473/564–568, 473/457, 519, 520
See application file for complete search history.

(56) References Cited

U.S. PATENT DOCUMENTS

| | | | | | |
|---|---|---|---|---|---|
| 780,244 | A | * | 1/1905 | Truesdell | 473/564 |
| 3,152,804 | A | * | 10/1964 | Costopoulos | 473/120 |
| 3,598,410 | A | * | 8/1971 | Costopoulos | 473/120 |
| 4,014,542 | A | | 3/1977 | Tanikawa | |
| 4,025,377 | A | | 5/1977 | Tanikawa | |
| 4,572,508 | A | | 2/1986 | You | |
| 5,042,805 | A | * | 8/1991 | Nakai | 473/320 |
| 5,114,144 | A | | 5/1992 | Baum | |
| 5,165,686 | A | | 11/1992 | Morgan | |
| 5,904,803 | A | | 5/1999 | Hillerich, III et al. | |
| 6,036,610 | A | | 3/2000 | Lewark | |
| 6,139,451 | A | | 10/2000 | Hillerich, III et al. | |
| 6,238,309 | B1 | * | 5/2001 | Sample | 473/564 |

OTHER PUBLICATIONS

Louisville Slugger® Composite Wooden Bat Model No. TPXC271, http://www.slugger.com/baseball/wood/tpxc271.html, printed Jul. 16, 2007.

* cited by examiner

*Primary Examiner*—Mark S Graham
(74) *Attorney, Agent, or Firm*—Hoffmann & Baron, LLP

(57) ABSTRACT

A reinforced baseball bat includes a single piece of solid, non-composite wood having a tubular barrel portion of a diameter at a distal end, a tubular handle portion at a proximal end having a smaller diameter than the diameter of the barrel portion, and a tapered tubular throat portion between the tubular barrel portion and the tubular handle portion. The reinforced bat further includes a plurality of grooves circumferentially disposed about the single piece of solid non-composite wood. At least one reinforcing member is circumferentially disposed within each of the plurality of grooves. The reinforcing member includes at least one elongate polymeric strand securably disposed within the each one of the plurality of grooves. A sealant is disposed within the plurality of grooves, covering the at least one polymeric strand or strands disposed therein.

13 Claims, 3 Drawing Sheets

REINFORCED WOODEN BASEBALL BAT

FIELD OF THE INVENTION

The present invention is related to a reinforced wooden baseball bat and a method for reinforcing a wooden baseball bat. More particularly, the present relation related to a wooden baseball bat having a plurality of circumferential grooves with a polymeric strand of reinforcing material securably disposed within the grooves.

BACKGROUND OF THE INVENTION

The force generated by hitting a baseball with a baseball bat may be quite large. Forces up to 8,000 to 9,000 pounds per square inch are not uncommon, especially with a fast-pitched baseball. Such potential high forces present safety concerns. A wooden bat may fracture during normal use, typically along a grain boundary, resulting in a sharply pointed projectile, which may be dangerous to both players and spectators.

Metal bats are also used in baseball. While the metal bats may not suffer from the potential fracture failure common with the wooden bats, metal bats may generate greater ball velocity off the bat, making the game of baseball more dangerous, especially for young or non-professional infielders, including pitchers. Some leagues and municipalities have even legislated against the use of metal bats in youth or scholastic sports, in an attempt to avoid potential injury.

Wooden bats have been reinforced to improve performance, including safety, strength or resistance against fracture. For example, U.S. Pat. No. 5,165,686 to Morgan describes the use of a rod of flexible plastic shaft centrally disposed within a wooden bat and extending throughout at least the handle section of the wooden bat to improve bat strength. U.S. Pat. No. 4,572,508 to You described a composite bat made from several wooden laminations with plastic layers disposed between the laminations to provide increase bat strength. U.S. Pat. No. 5,904,803 to Hillerich, III et al. describes a reinforced wooden baseball bat having a sleeve of braided fiberglass adhesively disposed over the entire exterior surface of a wooden bat. The wooden bat has longitudinally extending grooves which are described as being useful for providing the adhesive securement of the braided fiberglass sleeve to the wooden. U.S. Pat. No. 6,139,451 to Hillerich, III et al. attempts to improve adhesive securement of the fiberglass sleeve of the '803 patent, especially at the barrel portion of the bat, by providing a series of circular grooves at the barrel of the bat. The circular grooves are described as conduits for allowing air to escape from the longitudinal grooves as the adhesive is introduced into the longitudinal grooves. Such a composite bat, i.e., wooden core with a fiberglass outer sleeve, is commercially available as Louisville Slugger® Composite Bat TPXC271. Some of the composite bats, however, are not widely accepted in organized baseball leagues as the composite materials may alter the functionality of the wooden bat. In other words, while the prior art may have introduced reinforcement members to wooden bats, the resulting performance of the bat is altered as compared to the performance of a non-composite wooden bat.

The reinforced wooden bats of the prior art typically involve substantial use of non-wooden materials, including interiorly and/or exteriorly disposed non-wooden materials. Such composite bats, however, are not uniformly accepted by all leagues, for example Major League Baseball®. Further, the use of exteriorly disposed non-wooden materials may disrupt the natural wood finish more commonly associated with game of baseball.

Thus, there is a need in the art for an improved wooden baseball bat having enhanced reinforcement properties, but without substantially altering the function and/or the aesthetic view of the traditional wooden baseball bat.

SUMMARY OF THE INVENTION

In one aspect of the present invention a reinforced baseball bat is provided. The baseball bat may be made from a single piece of ash, maple, hickory, oak, birch, beech, elm or other suitable hardwood, but does not include wood made from composite materials, especially non-wooden materials, for example cork. The baseball bat includes a single piece of solid and generally tubular wood having a barrel portion of a diameter at a distal end, a handle portion at a proximal end having a smaller diameter than the diameter of the barrel portion, and a tapered throat portion between the barrel portion and the handle portion. At least one groove is circumferentially disposed about an outer portion of the single piece of solid and generally tubular wood, and at least one strand is securably disposed within the at least one groove. The strand is a reinforcing member according to the present invention. A sealant is also disposed within the groove and covering the at least one monofilament strand. The sealant adhesively secures the strand within the groove and further provides a smooth exterior finish to the bat area having the groove. The baseball bat may further include a plurality of strands disposed within the at least one groove. The strand or strands may be monofilament, desirably polymeric.

Desirably, the at least one groove is perpendicularly disposed about the grains of the single piece of solid wood, where grains typically run along the length of the wood or the bat. The at least one groove or groves may be circumferentially disposed about the barrel portion, the throat portion or the handle portion, desirably, around the barrel portion of the bat.

The baseball bat may further include a plurality of circumferential grooves; and a plurality of elongate strands, with at least one of the plurality of elongate strands being disposed within each one of the circumferential grooves. The plurality of circumferential grooves may be disposed about the barrel portion of the bat, the throat portion of the bat, the handle portion of the bat and combinations thereof. The grooves are generally non-interconnected to avoid portions of the grooves extending along a substantial length of the wood grains.

In another aspect of the present invention, a baseball bat includes essentially a single piece of solid wood having a tubular barrel portion of a diameter at a distal end, a tubular handle portion at a proximal end having a smaller diameter than the diameter of the barrel portion, and a tapered tubular throat portion between the tubular barrel portion and the tubular handle portion, and having a plurality of grooves circumferentially disposed about the single piece of solid non-composite wood; and at least one reinforcing member circumferentially disposed within each of the plurality of grooves; where the reinforcing member includes at least one elongate polymeric strand securably disposed within the each one of the plurality of grooves; and a sealant disposed within the plurality of grooves and covering the at least one polymeric strand disposed therein. A plurality of elongate strands may be securably disposed within each one of the plurality of grooves. The plurality of grooves may be circumferentially disposed about the tubular barrel portion, the tapered tubular throat portion, the tubular handle portion, and combinations thereof. Desirably, the plurality of grooves is circumferentially disposed about the tubular barrel portion. Further, the solid piece or billet of wood is typically a non-composite piece of wood that is further free of interiorly disposed non-wooden materials, especially materials lighter than the wood, for example cork.

In another aspect of the present invention a method of reinforcing a wooden baseball bat is provided. The method includes the steps of providing a baseball bat, which includes a single piece of solid wood having a barrel portion of a diameter at a distal end, a handle portion at a proximal end having a smaller diameter than the diameter of the barrel portion, and a tapered throat portion between the barrel portion and the handle portion; making at least one circumferential groove into the single piece of wood; securing at least one strand of polymeric material within the at least one circumferential groove; and filling the at least one groove and covering the at least one strand of polymeric material with a curable sealant. The step of making the at least one circumferential groove may include the step of forming the at least one circumferential groove about the barrel portion, the throat portion or the handle portion. The method may further include the steps of making a plurality of circumferential grooves, wherein the at least one circumferential groove and the plurality of circumferential grooves are formed about the barrel portion, the throat portion, the handle portion, and combinations thereof; securing at least one strand of polymeric material within each of the plurality of circumferential grooves; and filling the plurality of circumferential grooves and covering the at least one strand of polymeric material within each of the plurality of circumferential grooves with a curable sealant.

DETAILED DESCRIPTION OF PREFERRED EMBODIMENTS

Figure 1:
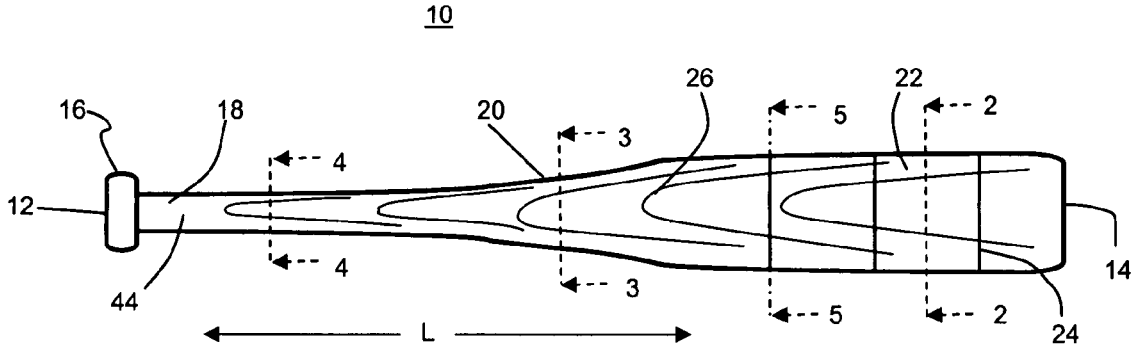
FIG. 1 is a longitudinal view of a reinforced wooden baseball bat according to the present invention.

FIG. 1 is a longitudinal view of a wooden baseball bat 10 of the present invention. The bat 10 includes a proximal end 12 and a distal end 14. Toward the proximal end 12 is the handle portion 18, around which a batter holds the bat 10. Toward the distal end 14 of the bat 10 is the barrel portion 22. The barrel portion 22 is used to strike a baseball. Disposed between the handle portion 18 and the barrel portion 22 is a throat portion 20. The throat portion 20 is a contoured portion disposed between the smaller diameter of the handle portion 18 and the larger diameter of the barrel portion 22. The proximal end 12 typically also includes a knob 16 which aids the batter in gripping the bat 10, especially when swinging the bat 10.

The bat 10 is made from a single piece or billet of wood 44, typically a hard wood. Useful hardwoods include, but are not limited to, ash, especially white ash; maple, especially sugar or black maple; hickory; oak, especially red oak; birch; beech; elm and poplar. Desirably, the hardwood is an ash or a maple hardwood. Hardwoods have a grain structure 26 which runs generally in the longitudinal direction of the bat 10, as depicted by vector "L". From about 7 to about 50 grains may be present in the hardwood bat 10. Typically, the bat 10 will have from about 7 to about 20 grains extending along the barrel portion 22.

The single piece of wood 44 is desirably a non-composite, i.e., one not formed by lamination, including lamination of wooden and non-wooden materials. The wood 44 further is also desirably a single piece of solid wood. The wood 44 is desirably free of interior bores or cavities, including ones than may be filled with a non-wooden material, for example cork. Thus, as used herein, the term "non-composite" refers to a single piece of solid wood and/or a wooden bat whose interior is free, or substantially free, of different wooden and/or non-wooden materials joined together, typically laminated, and whose interior is further free, including substantially free, of a cavity or bore having non-wooden material disposed therein.

The actual dimensions of the bat 10 may vary considerably, especially as the bat 10 may be used in a variety of settings, such as youth baseball, scholastic baseball, professional baseball and recreational baseball, including softball. The overall length of the bat 10 may vary from about 24 inches to about 42 inches. The smaller bat sizes are generally used by young players. Bat sizes from about 30 to about 36 inches are popular with adult players, including professional baseball players. Professional baseball, i.e., Major League Baseball®, sets a maximum limit of the bat length to 42 inches. Professional baseball also sets the maximum diameter of the barrel portion 22 to a maximum of about 2¾ inches. Other baseball formats may set lower barrel diameters. For example, some scholastic rules include a maximum barrel diameter or thickness of about 2⅝ inches. Many youth leagues further limit the barrel diameter to a maximum of about 2¼ inches. Thus, the diameter of the barrel 22 of the bat 10 may vary from about 2 inches to about 2¾ inches. Such diameters are nonlimiting and other diameters may suitably be used, especially in recreational settings. The overall weight of the bat 10 will vary with its size and choice of hardwood. Typically, the weight of the bat 10 in ounces should be not less than a value from about 3 to 5 less than the overall length in inches. For example, a 34 inch bat should weigh at least 31 ounces with the "less than 3" rule. Such a weight limitation varies among particular leagues. The thickness or diameter of the knob 16 is larger than the diameter of the handle 18. Typically, the diameter of the knob 16 is from about 1½ inches to about 2 inches.

The bat 10 of the present invention further includes reinforcement members 22, which are depicted in FIG. 1 as being disposed circumferentially about portions of the barrel 22. Desirably, the reinforcing member 24 extends perpendicular to the grain structure 26 of the bat 10. In other words, the reinforcing member extends circumferentially about the barrel 22 in a non-crossing, non-intersecting, non-spiral or non-helical manner, as indicted by vector "C" in FIG. 2.

Figure 2:
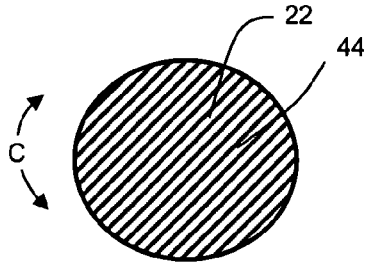
FIG. 2 is a cross-sectional view of a barrel portion of the wooden bat of FIG. 1 taken along the 2-2 axis.
Figure 3:
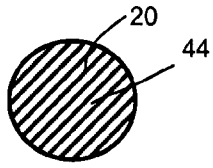
FIG. 3 is a cross-sectional view of a throat portion of the wooden bat of FIG. 1 taken along the 3-3 axis.
Figure 4:
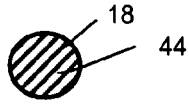
FIG. 4 is a cross-sectional view of a handle portion of the wooden bat of FIG. 1 taken along the 4-4 axis.

As depicted in FIGS. 2-4, the handle 18 has a smaller diameter than the diameter of the barrel 22. The throat portion 20 has a varied diameter which on average is between the size of the diameter of the barrel 22 and the diameter of the handle 18, as depicted in FIG. 3. Further, as depicted in FIGS. 2-4, the barrel 22, the throat 20 and the handle 18 are solid wooden members. In other words, the bat 10 of the present invention is made from a single piece or billet of hardwood 44. As the barrel 22, the throat 20 and the handle 18 are made from a single piece of solid wood 44, the bat 10 does not include other materials, for example cork, reinforcing rods, reinforcing textiles, and the like, extending through substantial interior portions of the bat 10. Further, the bat 10 is a non-composite bat as basic bat interior is free or substantially free of non-wood materials or combinations of different wooden portions or materials.

Figure 5:
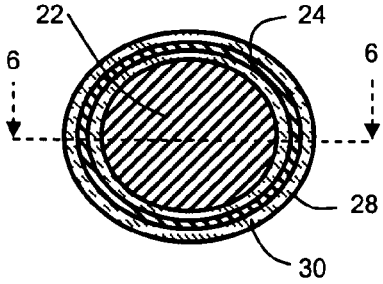
FIG. 5 is a cross-sectional view of a barrel portion of the wooden bat of FIG. 1 taken along the 5-5 axis showing a reinforcing member f the present invention.

FIG. 5 in a cross-sectional view of the bat 10 taken along the 5-5 axis of FIG. 1. The reinforcing member 24 is a generally circular member. The reinforcing member 24 is circumferentially disposed about the barrel portion 22 within a shallow groove 28 which is cut, milled or otherwise machined into the barrel portion 22. As the shallow groove 28 desirably is of minimal dimensions, the groove 28 may suitably be made even through use of an ordinary pocket knife.

Figure 6:
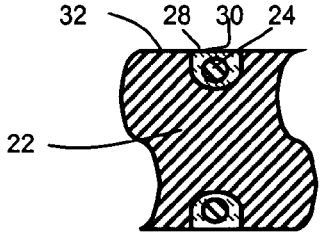
FIG. 6 is a partial cross-sectional view of a cutaway portion of the bat of FIG. 5 showing a reinforcing strand interiorly disposed within a groove near the surface of the bat, taken along the 6-6 axis.

A cross-section view of the groove 28 with the reinforcing member 24 is depicted in FIG. 6. As depicted in FIG. 6, groove 28 is a semicircular groove or notch that is disposed toward the outer surface 32 of the bat 10. The present invention, however, is not limited to grooves of semicircular shapes, and other shaped-grooves may suitably be used. For example, circular, square, rectangular, triangular and the like, may all be used a suitable shape for the cross-sectional profile of the groove 28. Further, as depicted in FIGS. 5 and 6, a sealant 30 may be used to secure the reinforcing member 24 within the groove 28. Desirably, as depicted in FIG. 6, the sealant 30 fills the groove 28 to provide a smooth surface or profile of the outer surface 32 of the bat 10. Any suitable adhesive may be used as the sealant 30. Desirably, the sealant 30 and the reinforcing member 24 are transparent, substantially transparent, partially transparent and/or translucent so that the bat 10 maintains the look of a natural wooden bat.

Figure 7:
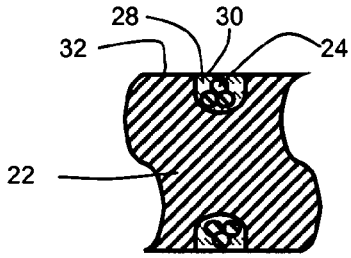
FIG. 7 is an alternate embodiment of the depiction of the cutaway portion of FIG. 6 showing a plurality of reinforcing members being disposed the groove of the bat.

The present invention, however, is limited to the use of a single reinforcing member 28 with the groove 28. For example, as depicted in FIG. 7, a plurality of reinforcing members 24 may be disposed with the groove 28. The number or plurality of reinforcing members 24 may vary, for example from about 2 to about 5. This number of reinforcing members is non-limiting and any suitable number that may be used within the groove 28. In general, the groove 28 is made with a small of profile, i.e., depth and width, as possible. A typical size, i.e., depth and width, of the groove 28 may vary in a nonlimiting fashion from about 0.0625 inches (or about a 1/16 of an inch or 2 mm) to about 0.5 inches (or about a ½ of an inch or 13 mm). Desirably, the depth and width, which may be the same or different, of the groove 28 may vary from about 0.0625 inches (or about a 1/16 of an inch or 2 mm) to about 0.25 inches (or about a ¼ of an inch or 6 mm), more desirably from about 0.0625 inches (or about a 1/16 of an inch or 2 mm) to about 0.128 inches (or about a ⅛ of an inch or 3 mm).

Figure 8A:
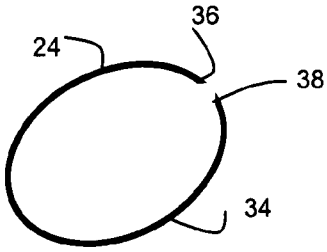
FIGS. 8A-8C are perspective view of the reinforcing member of the present invention.

As depicted in FIG. 8A, the reinforcing member 24 is an elongate strand 34. The strand 34 is desirably a polymeric strand. Monofilament strands, including monofilament polymeric strands, are also useful as these materials typically have high strength against breakage under stress. Desirably, the polymeric stands and/or monofilament strand may be any suitable material, including polyolefins, such as a polyethylene, high density polyethylene, polypropylene, and the like; polyamides, such as nylon; polyesters, such as polyethylene terephthalate; and copolymers thereof. Useful, but nonlimiting diameters for the strands 34 include from about 0.07 mm, or less, to about 5 mm, desirably from about 1 mm to about 3 mm. Commonly available fishing line may suitably be used as the reinforcing member 24. Useful fishing line strengths from about 2 to about 50 pounds may be used, desirably from about 10 pounds to about 30 pounds. The pound strength of a fishing line refers to the weight of a fish the line may secure without breaking. Actual tensile or breaking strength of fishing lines are typically larger that the stated pounds.

Figure 8B:
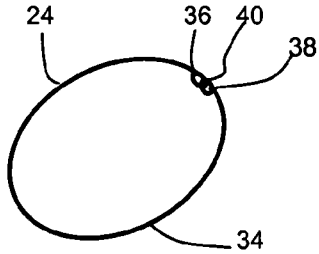
Figure 8C:
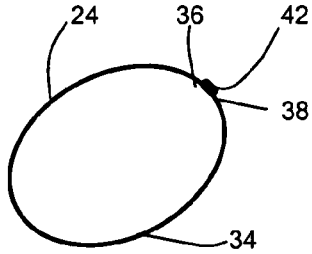

The reinforcing member 24 or stand 34 is advantageously sized to fit snugly within the groove 28. The elongate strand 34 has opposed ends 36, 38, as depicted in FIG. 8A. The ends 36, 38 may be secured to one and the other to provide adequate strength to the reinforcing member 24. For example, as depicted in FIG. 8B the ends 36, 38 may be formed into a knot 40 to formed the reinforcing member 24 within the groove 28. Alternatively, or in addition to, the ends 36, 38 may be heatingly fused to one and the other by forming a joined section or bead 42 of strand material, as depicted in FIG. 8C. The strands 34 of the present invention are not part of a textile pattern, such as a woven or braided pattern present in the prior art. Thus, the strand 30 or strands 34 in one groove 28 are not interconnected with the strand 30 or strands 34 in another groove 28. Further, the grooves 28 do not have a significant longitudinal extend along the length "L" of the bat 10, as present with a helical or spiral groove pattern. The grooves 28 of the present invention are single, circular grooves extending perpendicular or substantially perpendicular to the length "L" of the bat 10.

Figure 9:
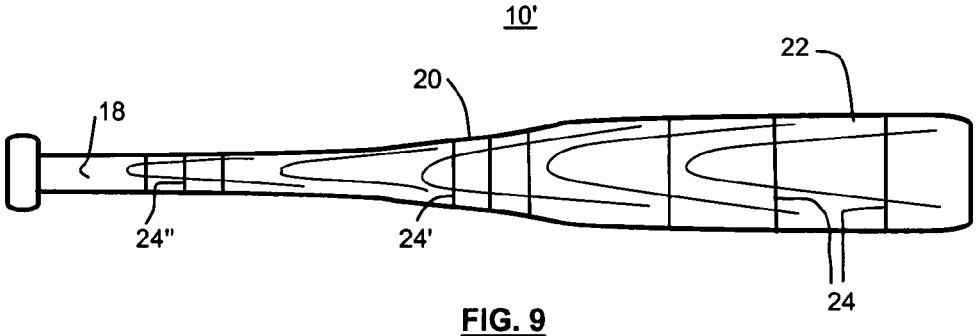
FIG. 9 is an alternate depiction of a bat according to the present invention showing reinforcing members disposed about a handle portion, a throat portion and/or a barrel portion of the bat of FIG. 1.

The present invention, however, is not limited to the placement of the reinforcing members 24 just at the barrel portion 22 of the bat 10. For example, as depicted in FIG. 9, reinforcing members 24' may be placed around the throat portion 20 of the bat 10' and/or reinforcing members 24" may be placed around the handle portion 18 of the bat 10'. Thus any section of the bat 10, 10', i.e., the handle 18, the throat 20 and/or the barrel; 20, may contain reinforcing members 24, 24', 24" of the present invention.

Figure 10:
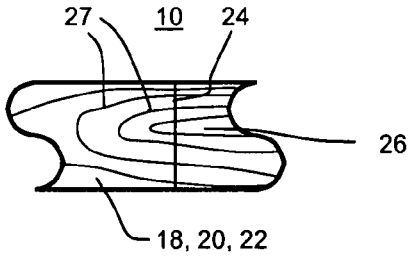
FIG. 10 depicts a reinforcing member of the present encompassing all of the grains of a grain structure within a portion of the wooden bat of the present invention.

As depicted in FIG. 10, the reinforcing member 24 of the present invention encompasses a group of grains 27 within the grain structure 26 within any portion 18, 20, 22 of the wooden bat 10. Desirably, the reinforcing structure 24 or structures 24 hold or encompass all of the grains 27 within the barrel portion 22 of the bat 10. Typically, from about 1 to about 3 reinforcing members 24 may be disposed about the barrel portion 22 to encompass all, or substantially all, the grains 27 with the barrel section 22 of the bat 10. Indeed, one reinforcing member 24 may be disposed toward the distal end 14 of the bat 10 within the barrel portion 22 to encompass all, or substantially all, the grains 27 thereat. Typically, from about 1 to about 2 reinforcing members 24' may be used to encompass all, or substantially all, the grains 27 in the throat portion 20 of the bat 10. Typically, from about 1 to 3 reinforcing members 24" may be used to encompass all, or substantially all, the grains 27 in the handle portion 18 of the bat 10. Thus, the bat 10 may include from about 6 to about 8 reinforcing members 24, 24', 24" so that all, or substantially all, of the grains 27 of the bat 10 are encompassed. The number of reinforcing members 24, 24' and/or 24" may vary depending upon the length of the bat 10 and the number of grains 27 within the grain structure 26.

As a minimal number of reinforcing members 24, 24' and/or 24" may be used to reinforce the bat 10, these reinforcing members do not change, or substantially change, the weight and consistency of the wooded bat 10. Further, as the reinforcing members 24, 24' and/or 24" and the grooves 28 containing the members 24, 24' and/or 24" are selected to have minimal dimensions, including width, thickness and/or length, a baseball (not shown) will always strike a wooden portion of the bat 10 which is free of such reinforcing members 24, 24' and/or 24" and grooves 28. Thus, the batting performance of the bat 10 will not be substantially changed from that of a similar bat which does not have such reinforcing members 24, 24' and/or 24" and grooves 28. Desirably, the bat 10 will have wooden portions of about 95% or greater by overall weight or by exterior surface area. More desirably, the bat 10 will have wooden portions of about 97% or greater by overall weight or by exterior surface area. Even more desirably, the bat 10 will have wooden portions of about 99% or greater by overall weight or by exterior surface area.

The reinforcing members 24 of the present invention provide the bat 10 increased with increased strength against breakage or fracture without altering the functionality or performance of the bat 10. One common indication of bat performance is the ball exit speed ratio (BESR), which is a measure of the liveliness of the collision of the bat and the ball. The BESR is a function of the velocity of the swinging bat ($V_{bat}$), the velocity of the pitched ball ($V_{pitch}$) and the velocity of the ball off of the bat ($V_{ballexit}$), as follows:

$$BESR = \frac{V_{ballexit} + 1/2 * (V_{pitch} - V_{bat})}{V_{pitch} + V_{bat}}$$

Some scholastic institutions, for example the National Collegiate Athletic Association (NCAA), have set a maximum BESR standard for bats. The current maximum BESR limit set by the NCAA is 0.728. Desirably, the BESR of the bat 10 is less than or equal to about 0.728. The reinforced bat 10 of the present invention does not alter or substantially alter the performance of the bat, including the BESR. In other words, the reinforced bat 10 of the present invention has the same or substantially similar weight and size characteristics of a typical non-composite, hardwood baseball bat; which results in the same or substantially similar performance, for example, but not limited to, BESR, of a traditional wooden baseball bat. Further, as the reinforcing member 24 may be small in width and substantially transparent, the look of the reinforced bat 10 is the same or substantially similar to that of a typical wooden bat. Thus, while the bat 10 of the present invention offers increased safety and strength against fracture, the look, feel and/or batting performance is not substantially altered.

Figure 11:
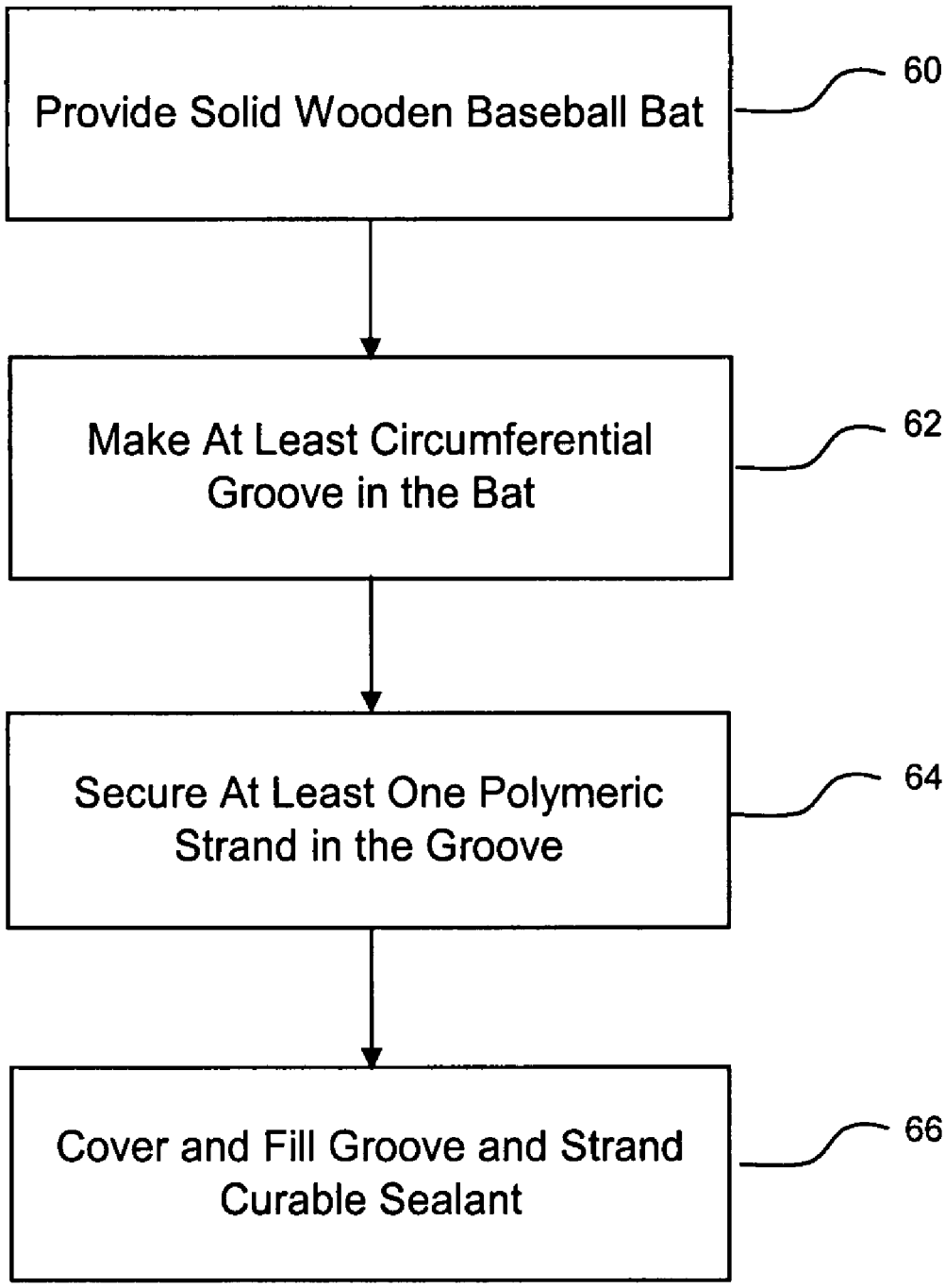
FIG. 11 is a schematic depiction of a method for reinforcing a baseball bat according to the present invention.

FIG. 11 is a schematic depiction of a method reinforcing a baseball bat. Step 60 includes the providing a baseball bat 10 comprising a single piece of solid wood 44 having a barrel portion 22 of a diameter at a distal end 14, a handle portion 18 at a proximal end 12 having a smaller diameter than the diameter of the barrel portion 22, and a tapered throat portion 20 between the barrel portion 22 and the handle portion 18. Step 62 includes the making of at least one circumferential groove 28 into the single piece of wood 44. More than one groove 28, including a plurality of grooves 28 may be made within the barrel portion 22, the throat portion 20 and/or the handle portion 18 of the bat 10. The groove or grooves 28 may be made by any suitable means. Step 64 includes the securing of at least one strand 24 of polymeric material within the at least one circumferential groove 28. Step 66 includes the filling of the at least one groove 28 and covering the at least one strand 24 of polymeric material with a curable sealant 30.

While various embodiments of the present invention are specifically illustrated and/or described herein, it will be appreciated that modifications and variations of the present invention may be effected by those skilled in the art without departing from the spirit and intended scope of the invention. Further, any of the embodiments or aspects of the invention as described in the claims or in the specification may be used with one and another without limitation.

What is claimed is:

1. A baseball bat comprising:

a single piece of solid wood having a barrel portion of a diameter at a distal end, a handle portion at a proximal end having a smaller diameter than the diameter of the barrel portion, and a tapered throat portion between the barrel portion and the handle portion;

a plurality of circumferential grooves circumferentially disposed about an outer portion of the single piece of solid wood, wherein the plurality of circumferential grooves are disposed about the barrel portion of the bat, the throat portion of the bat, the handle portion of the bat or combinations thereof;

at least one reinforcing strand having opposed ends, the at least one reinforcing strand being securably disposed within each of the plurality of circumferential grooves and the opposed ends of the at least one reinforcing strand being secured to one and the other; and a sealant disposed within the groove and covering the at least one reinforcing strand;

wherein the single piece of wood is substantially free of non-wooden materials or combinations of different wooden portion or materials; and wherein the bat has exterior wooden portions of about 95% or greater based on an exterior surface area of said exterior wooden portions free of the reinforcing members and the grooves such that a baseball will always strike a wooden portion of the bat which is free of the at least one reinforcing strand.

2. The baseball bat of claim 1, wherein the single piece of solid wood is a hardwood, wherein the hardwood is selected from the group consisting of ash, maple, hickory, oak, birch, beech or elm.

3. The baseball bat of claim 1, wherein the single piece of wood is a non-composite piece of wood.

4. The baseball bat of claim 1, further comprising a plurality of reinforcing strands disposed within each of the plurality of circumferential grooves.

5. The baseball bat of claim 1, wherein the single piece of solid wood comprises grains running along the length of the member and wherein each of the plurality of circumferential grooves are perpendicularly disposed about the grains.

6. The baseball bat of claim 1, wherein the at least one reinforcing strand is a monofilament strand.

7. The baseball bat of claim 6, wherein the monofilament stand is polymeric strand.

8. The baseball bat of claim 1, wherein the plurality of circumferential grooves consists essentially of from about 1 to 3 circumferential grooves disposed about the barrel portion of the bat, from about 1 to 2 circumferential grooves disposed about the throat portion of the bat, or from about 1 to 3 circumferential grooves disposed about the handle portion of the bat.

9. The baseball bat of claim 1, wherein the plurality of circumferential grooves consists essentially of from about 1 to 3 circumferential grooves disposed about the barrel portion of the bat, from about 1 to 2 circumferential grooves disposed about the throat portion of the bat, and from about 1 to 3 circumferential grooves disposed about the handle portion of the bat.

10. The baseball bat of claim 9, wherein a total number of circumferential grooves is from about 6 to 8 circumferential grooves.

11. The baseball bat of claim 1, wherein the bat has a ball exit speed ratio of less than or equal to about 0.728.

12. A method of reinforcing a wooden baseball bat, comprising:

providing a baseball bat comprising a single piece of solid wood having a barrel portion of a diameter at a distal end, a handle portion at a proximal end having a smaller diameter than the diameter of the barrel portion, and a tapered throat portion between the barrel portion and the handle portion, wherein the single piece of wood is substantially free of non-wooden materials or combinations of different wooden portion or materials;

making a plurality of circumferential grooves into the single piece of wood wherein the plurality of circumferential grooves are formed about the barrel portion, the throat portion, the handle portion, or combinations thereof;

providing at least one strand of polymeric material having opposed ends within each of the plurality of the circumferential grooves;

securing the opposed ends of the at least one strand of polymeric material to one and the other within each of the plurality of circumferential grooves;

filling the plurality of circumferential grooves and covering the at least one strand of polymeric material within each of the plurality of circumferential grooves with a curable sealant; and minimizing dimensions of the groove and the strand so that the bat has exterior wooden portions of about 95% or greater, based on an exterior surface of the exterior wooden portions, free of the grooves and the strands such that a baseball will always strike a wooden portion of the bat which is free of the at least one reinforcing strand.

13. The method of claim 12, further comprising minimizing the dimensions of the grooves and the strands to provide a bat performance of a ball exit speed ratio less than or equal to about 0.728.

* * * * *